US007343748B2

(12) United States Patent
Freesmeier et al.

(10) Patent No.: US 7,343,748 B2
(45) Date of Patent: Mar. 18, 2008

(54) DEVICE FOR RAPIDLY CHILLING ARTICLES IN A REFRIGERATOR

(75) Inventors: Jon Freesmeier, Cedar Rapids, IA (US); Xiaoyong Fu, Plano, TX (US)

(73) Assignee: Whirlpool Corporation, Benton Harbor, MI (US)

( * ) Notice: Subject to any disclaimer, the term of this patent is extended or adjusted under 35 U.S.C. 154(b) by 239 days.

(21) Appl. No.: 11/320,300

(22) Filed: Dec. 29, 2005

(65) Prior Publication Data

US 2007/0151284 A1 Jul. 5, 2007

(51) Int. Cl.
*F25D 25/00* (2006.01)
*F25D 17/06* (2006.01)
*F25D 17/04* (2006.01)

(52) U.S. Cl. ..... 62/62; 62/419; 62/407

(58) Field of Classification Search ..... 62/62, 62/404, 405, 407, 419, 381, 457.1, 457.4, 62/457.8, 372, 463; 220/737, 739, 903
See application file for complete search history.

(56) References Cited

U.S. PATENT DOCUMENTS 4,164,851 A 8/1979 Bryant
4,368,622 A 1/1983 Brooks
4,825,665 A 5/1989 Micallef
4,852,843 A 8/1989 Chandler
4,995,238 A * 2/1991 King ..... 62/125
5,092,395 A * 3/1992 Amidzich ..... 165/41
5,115,940 A 5/1992 Friedman
5,201,194 A * 4/1993 Flynn et al. ..... 62/457.3
5,207,762 A 5/1993 Newman
5,317,883 A 6/1994 Newman
5,505,054 A 4/1996 Loibl et al.
5,966,964 A 10/1999 Pattee
5,983,662 A 11/1999 Luetsch
6,050,104 A 4/2000 Corona
6,237,360 B1 5/2001 Corona
6,279,327 B1 8/2001 Zu Konigsegg
6,397,624 B1 * 6/2002 Horwell ..... 62/457.8
6,422,031 B1 7/2002 Mandel et al.
D463,218 S 9/2002 Wu et al.
6,533,232 B1 * 3/2003 Aggeler ..... 248/311.2
6,662,574 B2 12/2003 Loibl et al.
6,705,110 B1 * 3/2004 Worsham ..... 62/457.4

(Continued)

FOREIGN PATENT DOCUMENTS

WO WO 97/35155 * 9/1997

*Primary Examiner*—Mohammad M. Ali
(74) *Attorney, Agent, or Firm*—Michael D. LaFrenz; Kirk Goodwin

(57) ABSTRACT

A device for rapidly chilling containers in a refrigerator includes a base portion, an outer body portion and a carriage. The outer body portion includes an outer shell defining a central cavity. The carriage is rotatably supported in the central cavity and spaced from the outer shell so as to define an air channel. The carriage includes a support wall that defines an article receptacle. The support wall includes a plurality of openings that open to the air channel. A fan is provided to establish a cooling airflow that is directed through the air channel into the carriage. A motor is employed to selectively rotate the carriage. A plurality of rollers, at least one of which is driven by the motor, support and drive the carriage to rotate through the cooling airflow to rapidly lower the container temperature.

20 Claims, 4 Drawing Sheets

U.S. PATENT DOCUMENTS 6,895,775 B2 * 5/2005 Newman et al. ..... 62/378
6,976,369 B2 * 12/2005 Nothum, Jr. ..... 62/380
7,032,409 B1 * 4/2006 Worsham ..... 62/457.3
7,146,826 B1 * 12/2006 Schlosser ..... 62/457.9
7,178,343 B2 * 2/2007 Linder ..... 62/3.6
7,229,143 B2 * 6/2007 Gilman ..... 312/405.1
7,246,505 B2 * 7/2007 Navedo et al. ..... 62/420

* cited by examiner

DEVICE FOR RAPIDLY CHILLING ARTICLES IN A REFRIGERATOR

BACKGROUND OF THE INVENTION

1. Field of the Invention

The present invention pertains to the art of refrigerators and, more particularly, to a device provided in a compartment of a refrigerator for rapidly lowering a temperature of an article placed therein.

2. Discussion of the Prior Art

There has long been a demand for rapidly cooling beverage containers and the like. Whether the need is for quickly cooling a can or bottle of soda, chilling a bottle of wine or the like, consumers have a need for a device that will quickly chill a warm beverage. Waiting for a container that is simply placed into a refrigerator to chill is quite often too time consuming. For example, lowering the temperature of a can of soda to an acceptable level can take many hours. Placing the can in a freezer to speed the process can lead to bursting of the container. That is, if left unchecked, the contents can freeze and expand, resulting in bursting of the can. Towards that end, manufacturers have developed several devices that rapidly lower a temperature of an article, particularly a beverage container. The devices can range from simple holders that are immersed or positioned in a container of ice, to devices that rotate a container while simultaneously applying a cooling spray thereto.

The more simple devices are generally constituted by perforated containers fabricated from a highly conductive material, such as metal. A beverage bottle is placed into the container and the container is then placed in, for example, an ice bin. The conductive material conducts cold from the ice onto the bottle, while the perforations allow cool air to flow about and impinge on the bottle.

More advanced devices include fans that draw in air from, for example, a refrigerator compartment, and direct the air over a surface of a beverage container. This design generates air currents that run parallel to or along an outer surface of the beverage container. While effective to a degree, guiding air currents over the surface of a container in this manner does not result in the most efficient transfer of energy.

At the upper end of the scale, there exist quick chill devices that hold and rapidly chill a beverage container without the need for an external cooling source. Devices of this type typically utilize ice or a gas to alter the temperature of a container placed therein. One such device rotates the beverage container as melted ice is dripped or sprayed over the surface of the container. In addition to requiring motors to rotate the container, this type of device also requires reservoirs for holding, for example, ice or pumps for generating a spray or film, and an insulated housing.

Despite the existence of rapid chilling devices in the prior art, there still exists a need for an enhanced rapid chilling device, particularly a rapid chilling device which utilizes cooling air developed in a refrigerator, to quickly chill beverage containers. More specifically, there exists a need for a rapid chilling device that both rotates and directs jets of cool air onto the container.

SUMMARY OF THE INVENTION

The present invention is directed to a device for rapidly chilling beverage containers in a refrigerator. The rapid chiller device includes a base portion, an outer body portion and a carriage. In accordance with the invention, the outer body portion includes an outer shell that defines a central cavity within which the carriage is rotatably supported. Preferably, the carriage is spaced from the outer shell so as to define an air channel therebetween.

In further accordance with the invention, the carriage includes a cylindrical support wall that defines an article receptacle. The support wall is provided with a plurality of openings that allow cooling air to flow from the air channel into the article receptacle. A fan is provided that draws in cooling air from the refrigerator that is then directed through the air channel into the carriage. In addition to the fan, the beverage chiller includes a motor operatively connected to the carriage. The motor is selectively activated to rotate the carriage in the central cavity. A plurality of rollers, at least one of which is driven by the motor, support and drive the carriage about a substantially horizontal axis. With this arrangement, a beverage container placed within the carriage is rotated, while the cooling airflow is directed over the container. The combined rotation and airflow impingement rapidly lowers a temperature of the container.

In accordance with one embodiment of the invention, the rapid chiller device is mounted in a fresh food compartment of a refrigerator. More specifically, the rapid chiller device is mounted to an outlet of an air duct extending from the freezer compartment to the fresh food compartment. With this arrangement, cool air is guided directly from the freezer compartment to the rapid chiller device. In accordance with another embodiment of the invention, the rapid chiller is arranged in a box provided in the fresh food compartment. The box includes an inlet that is in fluid communication with the outlet of the air duct and an outlet that is in fluid communication with an inlet of the evaporator. In a still further embodiment, the rapid chiller device can be arranged in a freezer compartment of the refrigerator.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF THE PREFERRED EMBODIMENTS

Figure 1:
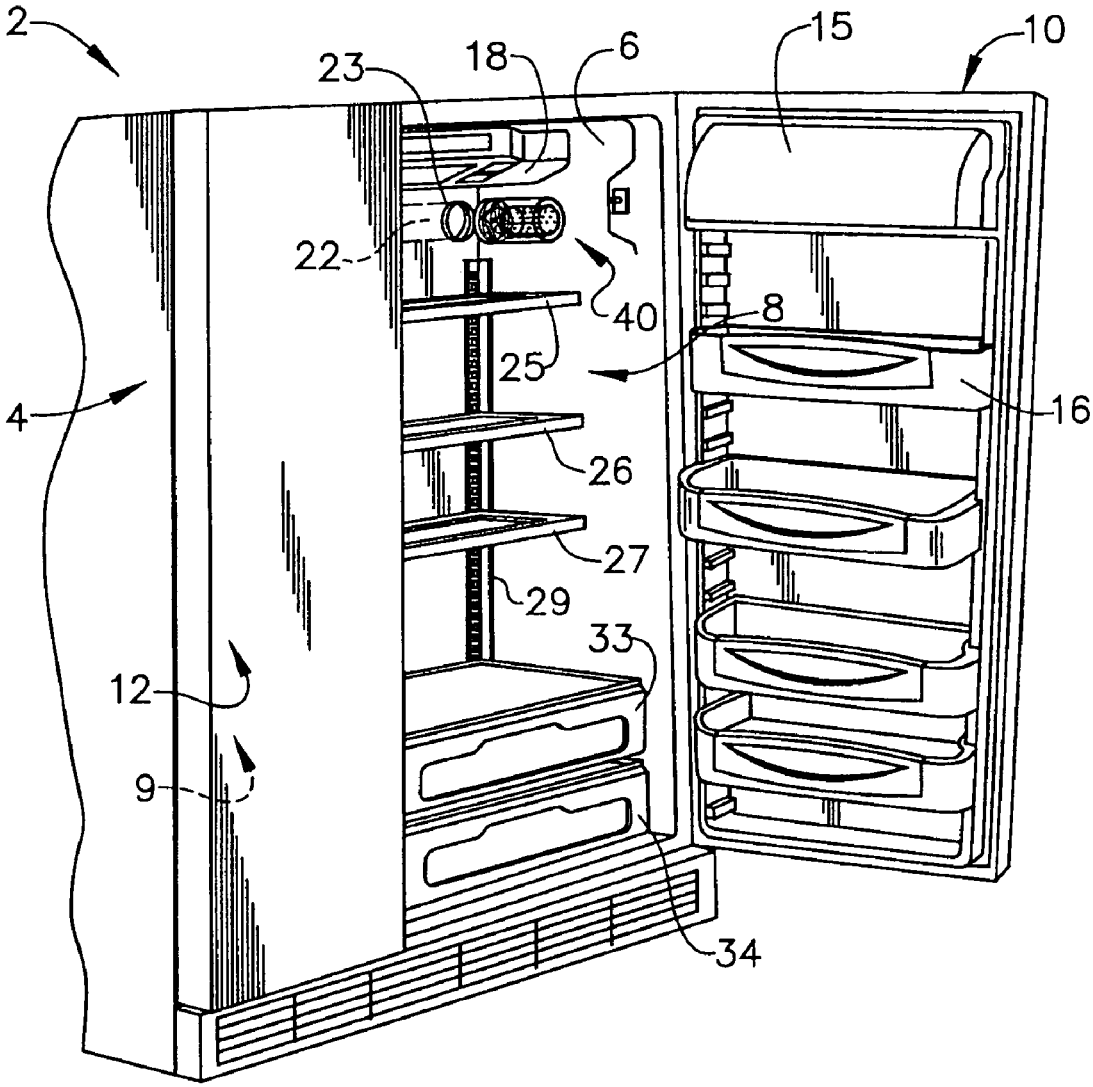
FIG. 1 is an upper right, partial perspective view of a refrigerator including a rapid chiller device constructed in accordance with the present invention.

With initial reference to FIG. 1, a refrigerator 2 includes an outer shell or cabinet 4 within which is positioned a liner 6 defining a fresh food compartment 8. A corresponding liner (not shown) defines a freezer compartment 9. In a manner known in the art, fresh food compartment 8 can be accessed by the selective opening of a fresh food door 10. In a similar manner, a freezer door 12 can be opened to access freezer compartment 9. For the sake of completeness, fresh food door 10 of refrigerator 2 is shown to include a dairy compartment 15 and various vertically adjustable shelving units, one of which is indicated at 16.

Mounted in an upper region of fresh food compartment 8 is a temperature control housing 18. Extending laterally across fresh food compartment 8, below temperature control housing 18, is a duct 22 having an outlet 23 that is in fluid communication with freezer compartment 9 of refrigerator 2. Also shown below temperature control housing 18 are a plurality of vertically spaced shelves 25-27 which are preferably mounted for selective vertical adjustment upon rear rails, one of which is indicated at 29. At a lowermost portion of fresh food compartment 8 is provided a pair of climate controlled bins 33 and 34.

The present invention is particularly directed to the incorporation of a rapid chiller device 40 into refrigerator 2. In the embodiment shown, rapid' chiller device 40 is adapted to mount to outlet 23. With this arrangement, cool air directed through duct 22 is guided onto an article, such as a beverage container, placed in rapid chiller device 40. The cooling air rapidly lowers the temperature of or chills the beverage container in a manner which will be detailed more fully below.

Figure 2:
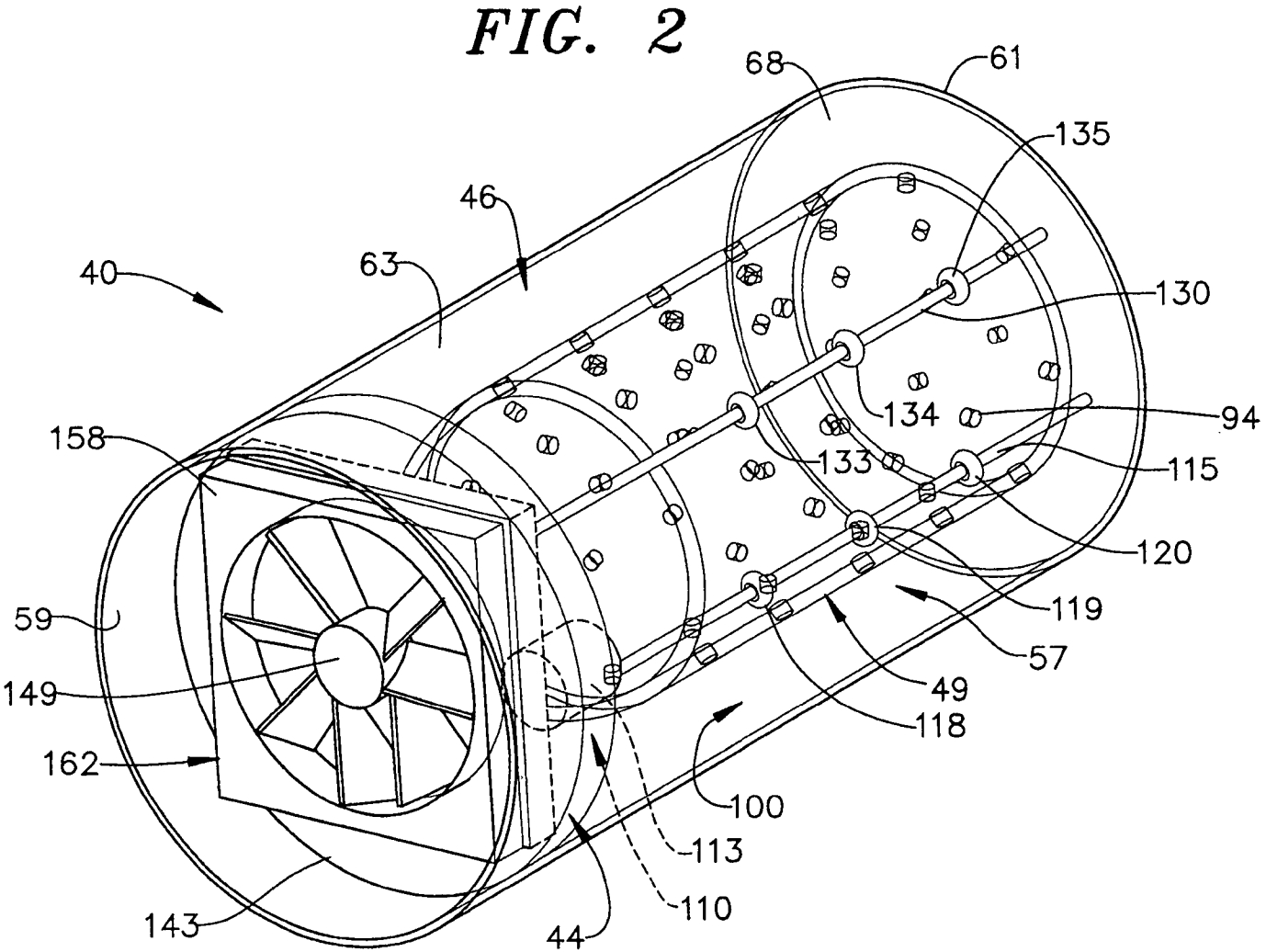
FIG. 2 is a rear perspective view of the rapid chiller device constructed in accordance with the present invention.
Figure 3:
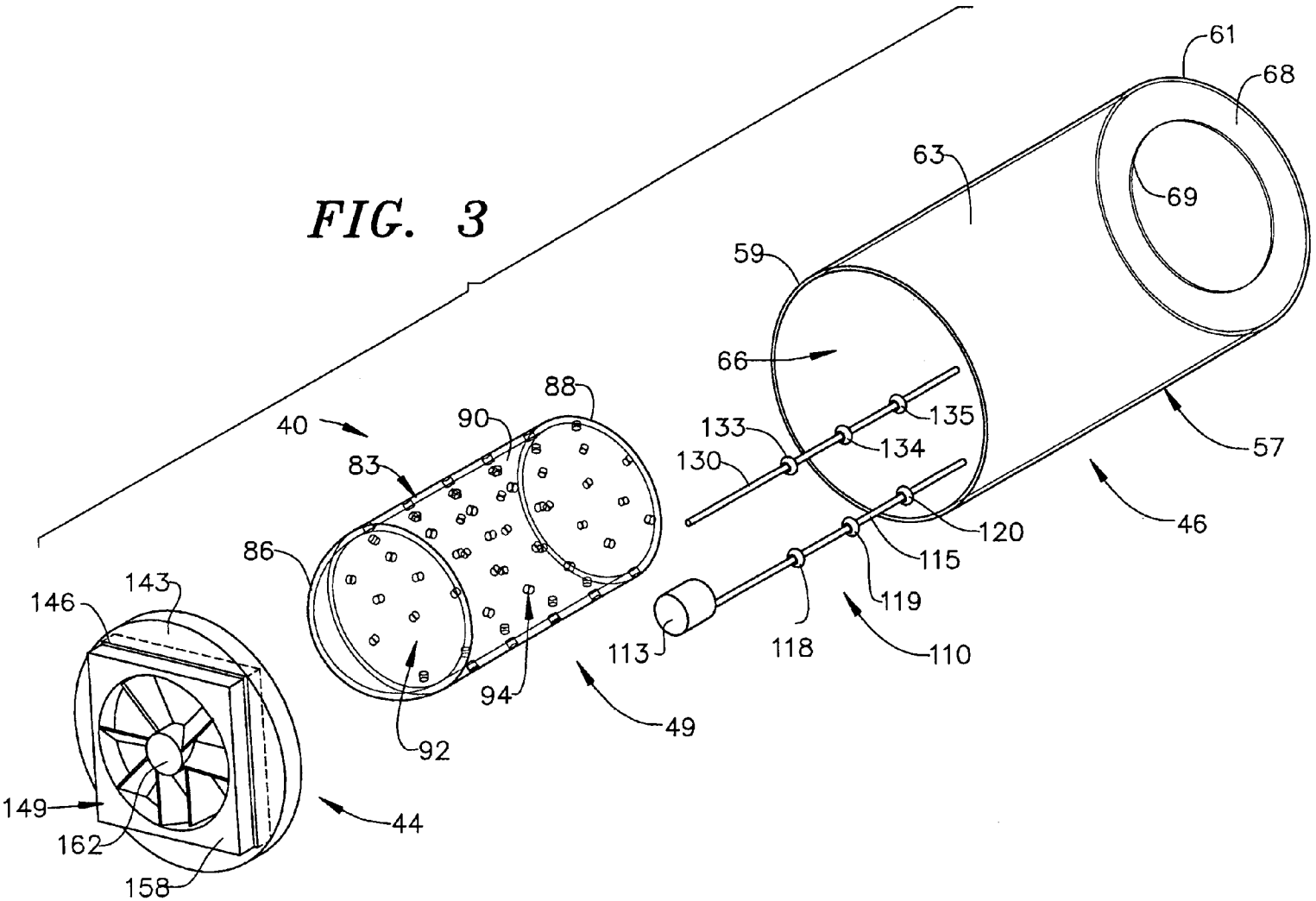
FIG. 3 is an exploded view of the rapid chiller device of FIG. 2.

Referring to FIGS. 2 and 3, rapid chiller device 40 includes a base portion 44, an outer body portion 46 and a carriage 49. As will be detailed more fully below, carriage 49 is rotatably supported within outer body portion 46 and adapted to receive an article to be chilled, for example, a beverage can or bottle. As best seen in FIG. 3, outer body portion 46 includes an outer shell 57 having a first end 59 that extends to a second end 61 through an intermediate portion 63. In the embodiment shown, outer shell 57 is generally cylindrical in shape and defines a central cavity 66. Additionally, arranged at second end 61 of outer shell 57 is an annular lip or ring 68 that defines an opening 69 which, as will be detailed more fully below, supports a portion of carriage 49. In accordance with one aspect of the invention, ring 68 acts as a support bearing for supporting, at least in part, carriage 49.

As further illustrated in FIG. 3, carriage 49 includes a cylindrical support wall 83 having a first end 86, which is preferably rounded or dome-shaped, that extends to a second end 88 through an intermediate portion 90. Cylindrical support wall 83 defines an article receptacle 92 for receiving containers and the like which a consumer desires to be rapidly chilled. Towards that end, arranged about intermediate portion 90 are a plurality of nozzles or openings, one of which is indicated at 94. As best shown in FIG. 2, when mounted in outer body portion 46, carriage 49 is spaced from outer shell 57 by an annular air channel 100. Openings 94 fluidly communicate with air channel 100 to permit cooling air to flow from air channel 100 to receptacle 92 as will be discussed further below.

In order to maximize the exposure of a beverage container placed within article receptacle 92 to a flow of cooling air, carriage 49 is preferably rotated about a longitudinal axis within outer body portion 46. In order to achieve the desired rotation, rapid chiller device 40 includes a drive system 110. In accordance with the invention, drive system 110 includes a motor 113 drivenly connected to a drive shaft 115. Motor 113 receives power from controls (not shown) arranged within refrigerator 2. In any case, drive shaft 115 is provided with a plurality of rollers 118-120 which frictionally engage an outer surface (not separately labeled) of support wall 83. In addition to drive shaft 115, drive system 110 also includes at least one idler shaft 130 which provides additional support to carriage 49 through a plurality of idler rollers 133-135. With this arrangement, activation of motor 113 causes rotation of drive shaft 115 such that rollers 118-120 frictionally engage and rotate carriage 49, while idler rollers 133-135 simply provide additional rotatable support for carriage 49.

In accordance with one preferred arrangement, rapid chiller device 40 is supported on outlet 23 through outer body portion 46. More specifically, first end 59 of outer body portion 46 is sized so as to snugly receive outlet 23 (see FIG. 1). Cool air is drawn into outer body portion 46 from duct 22 and guided to carriage 49. Towards that end, base portion 44 is shown to include a generally circular support disk 143 provided with a central opening 146. In the embodiment shown, central opening 146 is square-shaped. However, it should be understood that other shapes are equally acceptable as will become evident below. In any event, in order to provide the necessary air flow into rapid chiller device 40, a fan assembly 149 is mounted within central opening 146. Fan assembly 149 is fluidly exposed to duct 22 and is shown to include a fan housing 158 within which is rotatably mounted a fan or impeller 162. In addition to providing the structure necessary to support fan assembly 149, base portion 44 also provides at least a portion of the support for drive system 110. That is, both motor 113 and idler shaft 130 are supported, at least partially, by base portion 44.

With this overall construction, if a consumer desires to rapidly chill an article, such as a soda can indicated at 170 in FIG. 1, the article is initially placed within carriage 49. Thereafter, a control element (not shown) is activated to initiate operation of motor 113 and fan 162. Fan 162 draws in a cooling air flow, through duct 22. The cooling airflow is directed through base portion 44 into air channel 100. Once in air channel 100, the cooling air is guided through openings 94 provided on cylindrical support wall 83 to impinge upon the article positioned within receptacle 92. In accordance with the preferred embodiment shown, the air flow actually impinges directly upon the article within receptacle 92 at a substantially perpendicular axis to create a disturbance in a thermal layer about the article, thereby resulting in a rapid change in temperature. In this manner, the beverage chiller device 40 of the present invention provides an economical method of rapidly changing or chilling a temperature of an article without requiring a great deal of storage space within the refrigerator.

Figure 4:
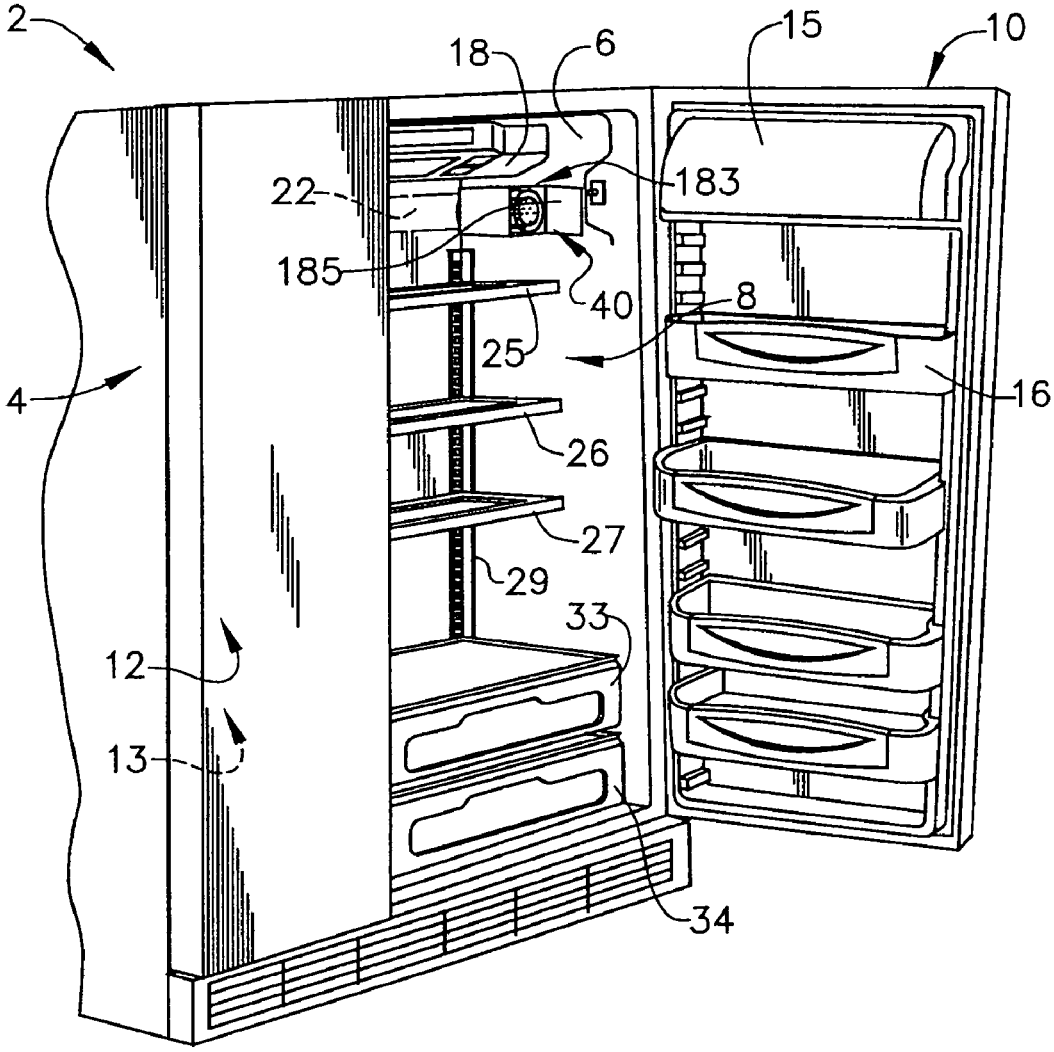
FIG. 4 is an upper right, partial perspective view of the refrigerator of FIG. 1 illustrating an alternative mounting arrangement for the rapid chiller device.

In an alternative arrangement illustrated in FIG. 4, rapid chiller device 40 is housed within a casing or box 183 shown mounted at an upper portion of fresh food compartment 8. Box 183 is provided with a door 185 to selectively close off a front portion of beverage chiller device 40. In this particular arrangement, box 183 includes an inlet that is in fluid communication with duct 22, as well as an outlet (not shown) that leads the cooling air flow back into an inlet portion of an evaporator (not shown). With this configuration, once a desired temperature is achieved, any container placed within rapid chiller device 40 would not be further chilled. That is, the recirculating airflow limits the temperature transfer to the container.

Although described with reference to preferred embodiments of the invention, it should be readily understood that various changes and/or modifications can be made to the invention without departing from the spirit thereof. For instance, the particular location of the rapid chiller device can vary without departing from the spirit of the present invention. In addition, in place of activating rapid chiller device 40 through the use of a separate control, a sensor can be placed within carriage 49 to sense the presence of an article, such as by weight, or breaking an IR beam, so as to automatically start operation of rapid chiller device 40. Furthermore, in addition to being arranged within a fresh food compartment of the refrigerator, rapid chiller device 40 could also be placed within freezer compartment 9. Finally, although the invention is particularly described with reference for use in rapidly chilling beverage containers, other food articles could also be placed in carriage 49 for a similar purpose. In general, the invention is only intended to be limited by the scope of the following claims.

We claim:

1. A refrigerator comprising:

a cabinet defining a fresh food compartment and a freezer compartment;

a door for selectively closing at least one of the fresh food and freezer compartments; and a rapid chiller device arranged in one of the fresh food and freezer compartments including:

a base portion;

an outer body portion extending from the base portion and defining a central cavity;

a carriage rotatably supported in the central cavity at a position spaced from the outer body portion such that an air channel is defined between the outer body portion and the carriage, said carriage having a support wall that defines an article receptacle, said support wall including a plurality of openings that are in fluid communication with the air channel;

a motor operatively coupled to the carriage, said motor selectively rotating the carriage within the central cavity; and a fan mounted to the base portion, said fan establishing a cooling airflow that is directed into the air channel to rapidly chill an article placed in the receptacle.

2. The refrigerator according to claim 1, wherein the rapid chiller device includes a drive member operatively connected to the motor and abutting the carriage, said drive member being selectively driven by the motor to rotate the carriage.

3. The refrigerator according to claim 2, wherein the drive member frictionally engages the carriage for rotating the carriage within the central cavity.

4. The refrigerator according to claim 3, wherein the drive member constitutes a roller.

5. The refrigerator according to claim 1, wherein the rapid chiller device includes an idler shaft provided with at least one idler roller, said idler roller providing rotational support to the carriage.

6. The refrigerator according to claim 1, wherein the rapid chiller device includes a support bearing positioned at a front portion of the carriage, said support bearing providing a forward support for the carriage.

7. The refrigerator according to claim 6, wherein the support bearing is constituted by a ring formed in a front portion of the outer body portion.

8. The refrigerator according to claim 1, further comprising: a duct leading into the fresh food compartment from the freezer compartment, said duct having an outlet accessible within the fresh food compartment, said rapid chiller device receiving a flow of cooling air from the outlet.

9. The refrigerator according to claim 8, wherein the rapid chiller device is mounted to the outlet, said fan including an inlet portion fluidly connected to the duct.

10. The refrigerator according to claim 1, further comprising a chiller box mounted in the fresh food compartment, wherein the rapid chiller device is arranged in the chiller box.

11. The refrigerator according to claim 1, wherein the openings in the support wall of the carriage are constituted by nozzles which direct a cooling airflow substantially perpendicular into the carriage.

12. A rapid chiller device for cooling a container in a refrigerator comprising:

a base portion;

an outer body portion extending from the base portion and defining a central cavity;

a carriage rotatably supported in the central cavity at a position spaced from the outer body portion such that an air channel is defined between the outer body portion and the carriage, said carriage having a support wall that defines an article receptacle, said support wall including a plurality of openings that are in fluid communication with the air channel;

a motor operatively coupled to the carriage, said motor selectively rotating the carriage within the central cavity; and a fan mounted to the base portion, said fan establishing a cooling airflow that is directed into the air channel to rapidly chill an article placed in the receptacle.

13. The rapid chiller device according to claim 12, further comprising: a drive member operatively connected to the motor and abutting the carriage, said drive member being selectively driven by the motor to rotate the carriage.

14. The rapid chiller device according to claim 13, wherein the drive member frictionally engages the carriage for rotating the carriage within the central cavity.

15. The rapid chiller device according to claim 14, wherein the drive member constitutes a roller.

16. The rapid chiller device according to claim 12, further comprising: an idler shaft provided with at least one idler roller, said idler roller providing rotational support to the carriage.

17. A method of rapidly chilling an article placed in a refrigerator mounted rapid chiller device including a base portion, an outer body portion extending from the base portion and defining a central cavity, and a carriage having a support wall that defines an article receptacle comprising:

placing an article in the carriage;

guiding a cooling airflow from a freezer compartment into an air channel defined by a space located between the outer body portion and the carriage;

rotating the carriage about an axis of rotation in the central cavity;

directing the airflow through openings provided about the carriage onto the article placed therein to create a disturbance in a thermal layer about the article in order to rapidly bring about a temperature reduction in the article.

18. The method of claim 17, further comprising: guiding the airflow substantially perpendicular to the axis of rotation of the carriage onto the article.

19. The method of claim 18, further comprising: rotating the carriage through operation of a drive member including at least one roller in frictional engagement with the carriage.

20. The method of claim 19, further comprising: rotatably supporting a portion of the carriage on an idler roller carried by an idler shaft.

* * * * *